US006901692B2

(12) United States Patent
Miller

(10) Patent No.: US 6,901,692 B2
(45) Date of Patent: Jun. 7, 2005

(54) FASTENING DEVICE FOR AN AIMING TELESCOPE ON A WEAPON

(75) Inventor: Benno Miller, Innsbruck (AT)

(73) Assignee: Swarovski Optik KG, Absam i. Tirol (AT)

( * ) Notice: Subject to any disclaimer, the term of this patent is extended or adjusted under 35 U.S.C. 154(b) by 1 day.

(21) Appl. No.: 10/443,993

(22) Filed: May 23, 2003

(65) Prior Publication Data

US 2004/0009034 A1 Jan. 15, 2004

(30) Foreign Application Priority Data

Jul. 9, 2002 (EP) ..... 02015263

(51) Int. Cl.[7] ..... F41G 1/38

(52) U.S. Cl. ..... 42/124; 42/125; 33/245; 33/247

(58) Field of Search ..... 33/245, 247, 250, 33/252; 42/124, 125, 127

(56) References Cited

U.S. PATENT DOCUMENTS 2,583,260 A 1/1952 Felix
2,649,779 A 8/1953 Hardgrove et al.
2,854,748 A 10/1958 Williams
4,959,908 A * 10/1990 Weyrauch ..... 42/124

FOREIGN PATENT DOCUMENTS

DE 962 410 4/1957
DE 38 20 471 A1 12/1989

* cited by examiner

*Primary Examiner*—J. Wodrow Eldred
(74) *Attorney, Agent, or Firm*—Fulbright & Jaworski LLP

(57) ABSTRACT

A fastening device for attaching an aiming telescope (1) on a weapon using a mounting rail (2) connected to a telescope housing and extending along the telescope, the mounting rail being supported on at least one mounting apparatus (3*a*, 3*b*) fastened to the weapon. The mounting rail is provided with a longitudinal groove (5) and a clamping part (7) corresponding to an inside profile of the longitudinal groove (5) is inserted into the groove and fixed with an attaching screw (8) that engages threads (9) in the clamping part (7). The attaching screw (8) is passed through an opening (11*a*, 11*b*) in the mounting apparatus (3*a*, 3*b*). The mounting rail (2) is provided on the side facing the mounting apparatus (3*a*, 3*b*) with a toothing (22) that is engaged by at least one projection (23) protruding from the mounting apparatus.

17 Claims, 3 Drawing Sheets

FASTENING DEVICE FOR AN AIMING TELESCOPE ON A WEAPON

BACKGROUND OF THE INVENTION

1. Field of the Invention

The present invention relates to a device for fastening an aiming telescope on a weapon. More particularly, the present invention relates to a fastening device having a mounting rail for connection to a telescope housing and extending along a length of the telescope. The mounting rail being supported on at least one mounting apparatus that is fastened to the weapon, and the mounting rail having a longitudinal groove for insertion of a clamping part corresponding to the inside profile of the groove so the clamping part can be fixed with an attaching screw engaging a thread in the clamping part through an opening in the mounting apparatus.

2. Description of the Related Technology

An apparatus for fastening an aiming telescope on a weapon must ensure exact and stable connection of the aiming telescope on the weapon so that the line of sight does not change despite shock loads produced by weapon recoil.

Further, aiming telescopes should be easily fastenable to and detachable from a mounting apparatus. The aiming telescope must also not be damaged by the connection. Moreover, lightweight, and low profile construction are required. Finally, the aiming telescope should be fastenable in axially different positions relative to the mounting apparatus.

It is known to provide the aiming telescope with a mounting rail of dovetailed cross section so as to attach a mounting apparatus on the weapon with clamping jaws, and to clamp the mounting rail between the clamping jaws with a clamping screw penetrating the clamping jaws and at a cross bore in the mounting rail.

However, such arrangements require bores to be made during mounting of the aiming telescope that lead to damage and thus depreciation of the telescope. Also, the bores involve increased expenditure of labor. Moreover, the dovetailed mounting rail must have a considerable overall height to permit the bores to be made, which results in increased weight of the mounting rail and thus the aiming telescope.

Further, DE 38 20 471 C2 discloses a fastening apparatus of the type stated at the outset. A wedge-shaped mounting rail is drawn firmly into a wedge-shaped groove in a mounting apparatus with a clamping part when an attaching screw is tightened. Even slight loosening of the attaching or clamping screw leads to detachment of the connection and thus maladjustment between aiming telescope and weapon. Since weapon firing forces are absorbed only by frictional forces, high clamping forces are moreover required. So that the mounting rail is not deformed by high clamping forces, the mounting apparatus must be of solid design in the area of the guide groove, which causes increased weight.

SUMMARY OF THE INVENTION

An object of the present invention is to provide a low profile and lightweight device for precise and stable connection of an aiming telescope to a weapon with a mounting apparatus.

According to an embodiment for the present invention, a fastening device including a mounting rail is connected to and extends along an aiming telescope housing. The mounting rail being supported on at least one mounting apparatus fastened to the weapon, and the mounting rail having a longitudinal groove for insertion of a clamping part that can be fixedly attached using a screw passed through an opening in the mounting rail. Furthermore, the mounting rail includes a set of teeth on the side facing the mounting apparatus. These teeth are engaged by at least one projection extending from the mounting apparatus. The set of teeth or toothing extending from the mounting rail and engaged by a projection from the mounting apparatus ensure that axial forces acting on the aiming telescope are positively absorbed.

Preferably, the clamping part extends into an opening in the mounting apparatus. Thus, the clamping part is longer than the overall height of the inside profile of the mounting rail. This arrangement guarantees that there can be a low overall height of the mounting rail. Moreover, the mounting rail is formed with a groove or hollow section, which additionally reduces the weight of the mounted aiming telescope. Also, the clamping part extends into the opening in the mounting apparatus to ensure sufficient thread length and thus a very reliable screw interconnection.

Due to a positive fit (i.e., a close tolerance and continuous fit but not a forced fit between attaching parts and surrounding parts) the attaching screws are not overly stressed by weapon firing forces so there is little danger of the screws loosening.

The clamping part preferably rests in a positive fit with its outside circumference adjacent sides of an opening into the longitudinal groove in the mounting rail and also adjacent the surface of the opening in the mounting apparatus. This positive fit connection provides a tight lateral guidance between the mounting rail and the clamping part. Thus, lateral forces occurring during firing are reliably absorbed and the danger of misadjustment of the aiming telescope is eliminated.

Furthermore, no massive lateral shoulders are required on the mounting apparatus. Rather, the mounting rail can be supported on the mounting apparatus from a flat surface. Thus, the mounting apparatus can be formed quite light. Also, the sides of the mounting rail remain largely free and smooth so they can be adapted to the appearance of the aiming telescope.

According to the present invention, the fastening of the aiming telescope is effected without damaging the aiming telescope or actually having to damage it. A simple tool, such as a screwdriver, suffices for fastening the aiming telescope to the mounting apparatus.

Instead of a flat surface, the mounting apparatus also can have on the side facing the mounting rail, for absorbing lateral forces, a flat longitudinal groove with a rectangular cross section. For example, the flat longitudinal groove in the mounting apparatus can be engaged in a positive fit by an accordingly rectangular flat projection extending from the mounting rail.

Moreover, the mounting apparatus can be provided with an insert into which the clamping part can extend. The insert and mounting apparatus can be made of different materials, for example steel and aluminum. Such construction allows for a further weight saving.

BRIEF DESCRIPTION OF THE DRAWINGS

In the following enabling disclosure the present invention will be explained in more detail by way of example with reference to the enclosed drawings, in which.

DETAILED DESCRIPTION

Figure 3:
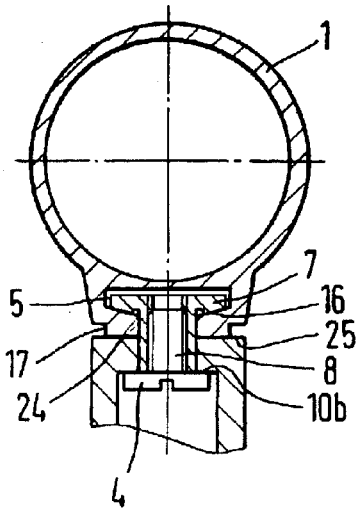
FIGS. 2 and 3 show cross sectional views along lines II—II and III—III according to FIG. 1 of the aiming telescope and device for fastening.
Figure 2:
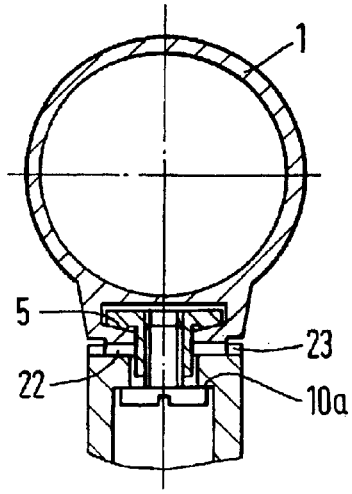
Figure 4:
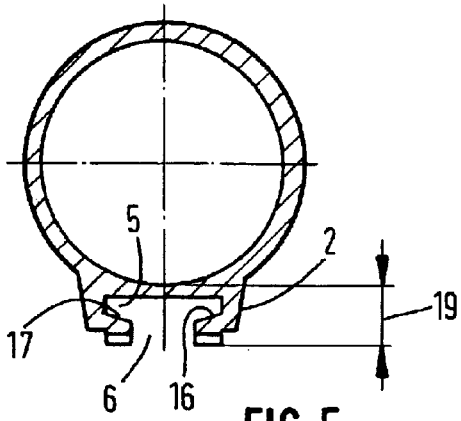
FIG. 4 shows a cross sectional view through the aiming telescope according to FIGS. 1–3 without a mounting apparatus.
Figure 5:
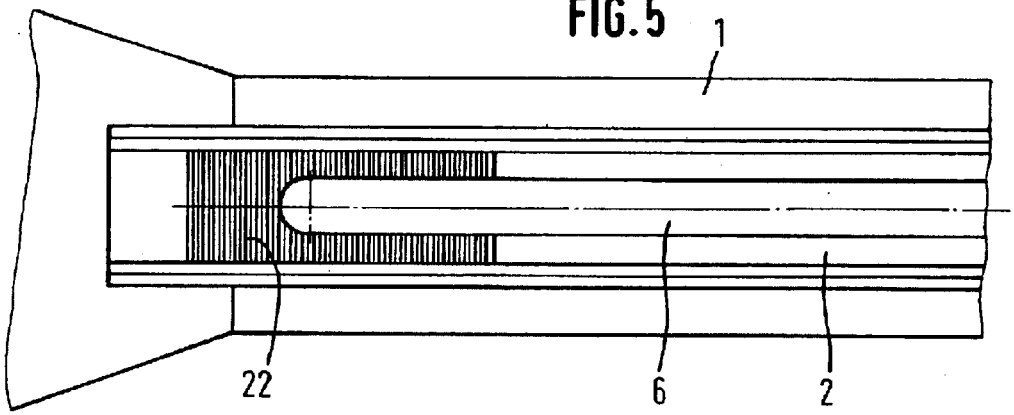
FIG. 5 shows a partial plan bottom view of the aiming telescope shown in FIG. 1.
Figure 6:
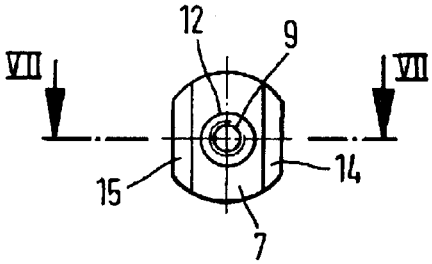
FIG. 6 shows a plan bottom view of a clamping part shown in FIG. 1.
Figure 7:
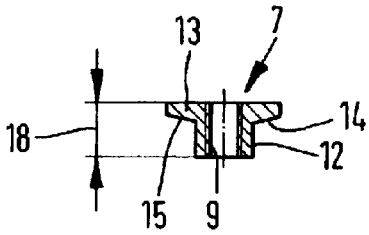
FIG. 7 shows a cross sectional view through the clamping part along line VII—VII shown in FIG. 6.

According to FIGS. 1 to 7, an aiming telescope 1 has an included mounting rail 2 extending at least over part of the length of the aiming telescope 1. Supported from mounting rail 2 are two bearings or mounting apparatuses 3*a*, 3*b* that are spaced apart to be fastened to a weapon (not shown). Mounting rail 2 is formed as having a hollow structure, i.e. it has a longitudinal groove 5 with a longitudinal opening 6 (FIG. 4). A clamping part 7 is inserted into longitudinal groove 5 as shown in FIG. 3. To permit clamping part 7 to be inserted into groove 5, opening 6 has a large enough cross section at one end (not shown) to accept entrance of clamping part 7.

Clamping part 7 is provided with internal threads 9 that are engaged by attaching screw 8. Clamping parts 7 protrude through openings 11*a*, 11*b* and into mounting apparatuses 3*a*, 3*b*. With their heads 4, screws 8 are supported on inside shoulders 10*a*, 10*b* in mounting apparatuses 3*a*, 3*b* (see FIGS. 2 and 3).

Clamping parts 7 extend into openings 11*a*, 11*b* of mounting apparatuses 3*a*, 3*b*. Clamping parts 7 thus are formed with a T-shaped cross section. The vertical bar of the T-shaped cross section is constituted by sleeve-shaped portion 12, while the crossbar of the T-shaped cross section is constituted by head 13 having on its underside on both sides of portion 12 clamping surfaces 14, 15 that are thicker in a wedge shape toward portion 12 (FIGS. 6 and 7) and that cooperate with accordingly inclined clamping surfaces 16, 17 in longitudinal groove 5 on both sides of longitudinal opening 6.

A bore with internal threads 9 extends through sleeve-shaped portion 12 and head 13. Sleeve-shaped portions 12 of clamping parts 7 extend through longitudinal opening 6 in mounting rail 2 and into openings 11*a*, 11*b* of the two mounting apparatuses 3*a*, 3*b*. Clamping part 7 thus has overall height 18 (FIG. 7) that is substantially greater than the overall height of the inside profile of longitudinal groove 5. Thus, mounting rail 2 can have small overall height 19 (FIG. 4). Sleeve-shaped portion 12 of clamping part 7 rests with its outside circumference having a positive fit in contact with both sides of walls of opening 6 of longitudinal groove 5, and its outside circumference further rests in a close tolerance and continuous fit, i.e., a positive fit, against the walls of openings 11*a*, 11*b* of mounting apparatuses 3*a*, 3*b*.

Figure 1:
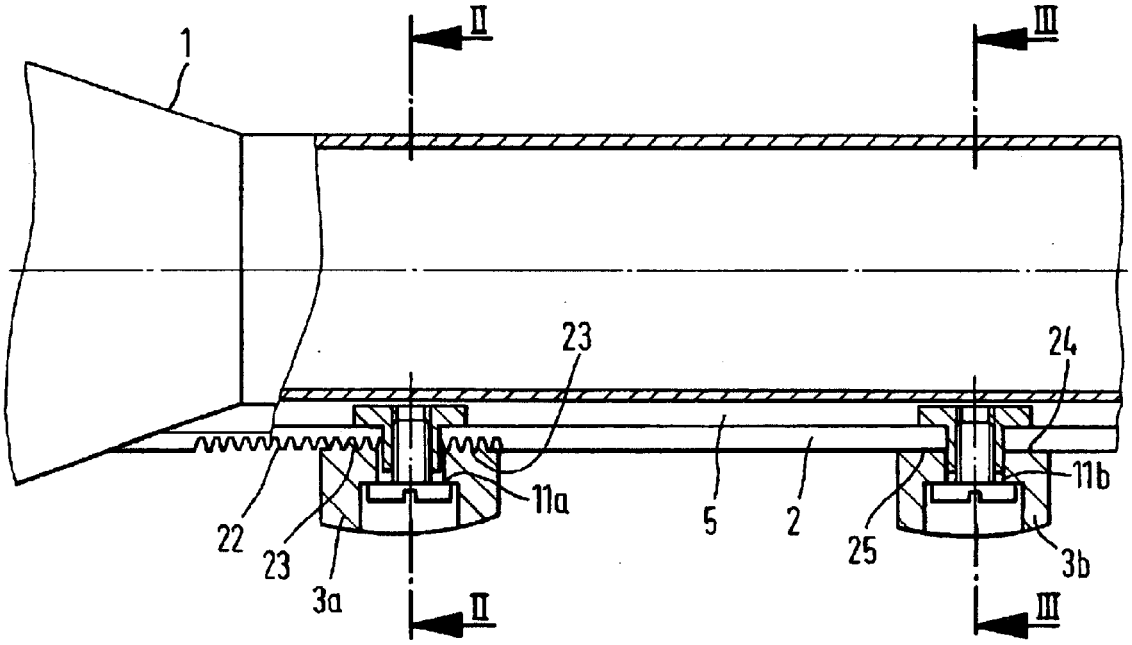
FIG. 1 shows a longitudinal partial sectional view through a part of an aiming telescope and a first embodiment of a device for fastening the aiming telescope to a weapon (not shown)

Mounting rail 2 at one end is provided on both sides of longitudinal opening 6 with a set of teeth or toothing 22 on the side facing mounting apparatus 3*a* and in the area where mounting apparatus 3*a* is to be attached to mounting rail 2. Mounting apparatus 3*a* in turn has on the side facing mounting rail 2 projections forming teeth 23 (FIG. 1) that extend along the longitudinal direction of aiming telescope 1 for engaging toothing 22 on mounting rail 2. Teeth 23 and the teeth of toothing 22 can be, for example, of trapezoidal, rectangular or other appropriate form. In contrast, mounting rail 2 is supported in the area of the other mounting apparatus 3*b* with flat surface 24 resting on flat surface 25 of mounting apparatus 3*b* (FIGS. 1 and 3).

Figure 9:
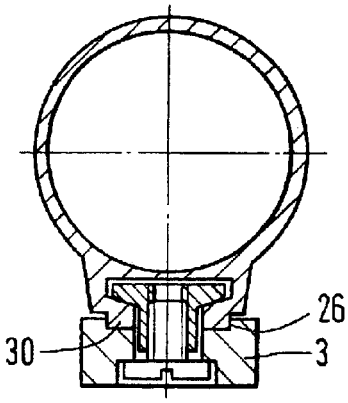
FIG. 9 shows a cross sectional view along line IX—IX according to FIG. 8 of the telescope and device for fastening.
Figure 8:
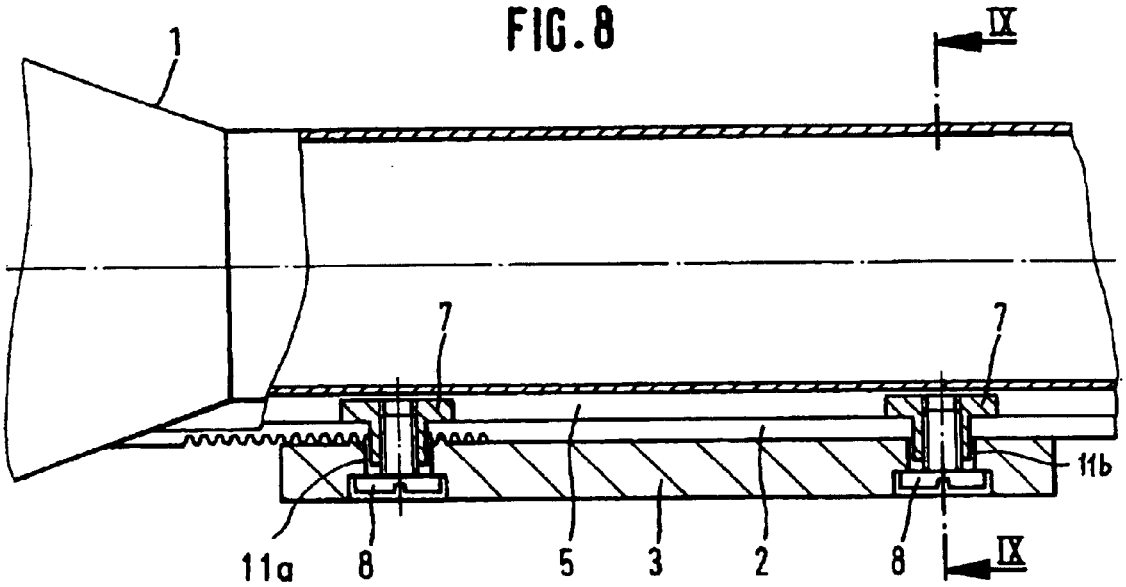
FIG. 8 shows a longitudinal partial sectional view through a part of an aiming telescope and a device for fastening the aiming telescope to a weapon according to another embodiment of the present invention.

The embodiment of the present invention according to FIGS. 8 and 9 substantially differs from that according to FIGS. 1–7 in that mounting apparatus 3 is formed as a one-piece rail having on the side facing mounting rail 2 flat longitudinal groove 26 of rectangular cross section that is engaged in a positive fit by projection 30 of rectangular cross section that extends from mounting rail 2. Mounting apparatus 3 extends along the weapon (not shown) and is provided with openings 11*a*, 11*b* through which attaching screws 8 extend into clamping part 7 in each case.

Figure 11:
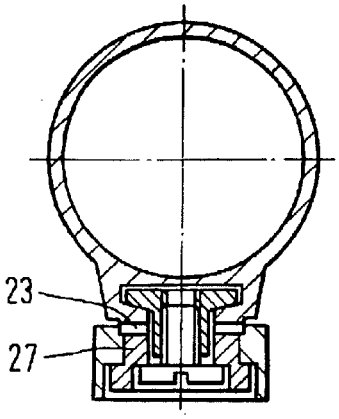
FIG. 11 shows a cross sectional view along line XI—XI according to FIG. 10 of the aiming telescope and device for fastening.
Figure 10:
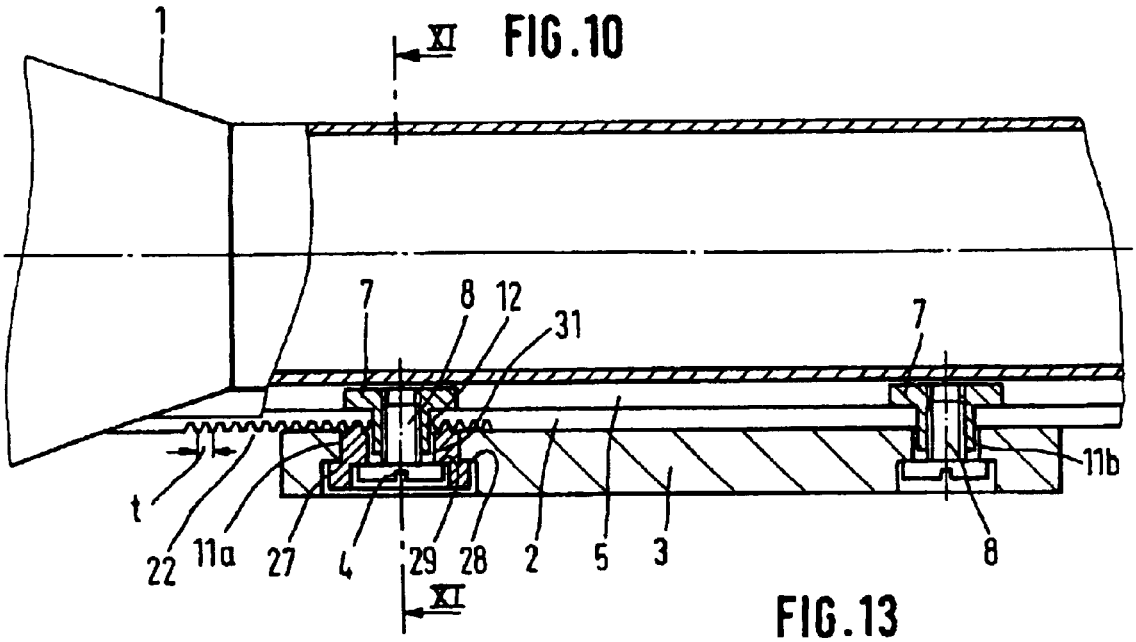
FIG. 10 shows a longitudinal sectional view through a part of an aiming telescope and a device for fastening the aiming telescope to a weapon according to a further embodiment of the present invention.
Figure 12:
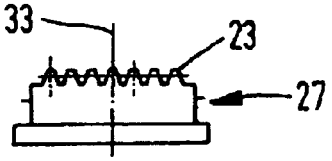
FIG. 12 shows a plan side view of the insert of the fastening device according to FIGS. 10 and 11.

According to FIGS. 10, 11 and 12, insert 27 is provided in conjunction with mounting apparatus 3 at one opening 11*a*, the insert 27 being shown separately in FIG. 12. Insert 27, as shown, is provided with teeth 23 (FIG. 12) that engage toothing 22 (FIG. 10) which extend from mounting rail 2 of telescope 1.

Insert 27 is of T-shaped cross section, the vertical bar of the T-shaped cross section constitutes the portion with which insert 27 protrudes through opening 11*a* in mounting apparatus 3; it also is provided with teeth 23 that engage toothing 22. In contrast, the crossbar of the T-shaped cross section of insert 27 is supported on inside shoulder 28 (FIG. 10) in mounting apparatus 3 at the end of opening 11*a* facing away from mounting rail 2.

Further, insert 27 in turn has inside shoulder 29 on which head 4 of screw 8 is supported. Finally, insert 27 has inside recess 31 (FIG. 10) into which sleeve-shaped portion 12 of clamping part 7 extends. Teeth 23 can be offset by one quarter pitch "t" of toothing 22 from cylinder axis 33 of insert 27 in overall respect to mounting apparatus 3 as shown in FIGS. 10 and 11. Accordingly, the axial length of the aiming telescope can be fixed precisely at one half pitch "t" relative to mounting apparatus 3 depending on the mounting position of insert 27.

Figure 13:
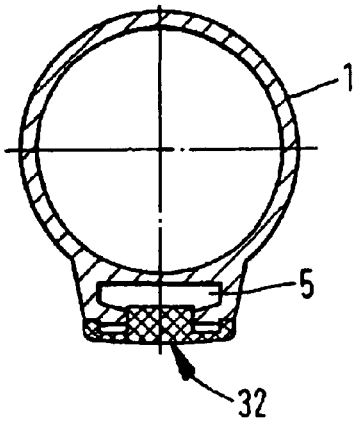
FIG. 13 shows a protective cover for the groove in the mounting rail that extends from the aiming telescope.

As shown in FIG. 13, opening 6 into groove 5 of mounting rail 2 can be closed with a cover 32 along the areas of opening 6 that are not covered by mounting apparatuses 3*a*, 3*b*. The cover 32 has a T-shaped cross section with the vertical bar of the T-shaped cross section extending into the longitudinal groove 5 of mounting rail 2; while the crossbar of the T-shaped cross section is positioned to be engaged over the outside of mounting rail 2 that faces mounting apparatus 3, 3*a*, 3*b* when telescope 1 is mounted. Cover 32 protects longitudinal groove 5 from dirt and soiling. Also, the appearance of telescope 1 is improved by covering 32. Cover 32 is preferably made of an easily cuttable material. Thus, the required length of cover 32 can be adapted to any particular mounting in a simple way.

What is claimed is:

1. A telescope fastening device for mounting a telescope housing to a weapon, said telescope fastening device comprising:

a mounting rail disposed from said telescope housing, said mounting rail including a groove extending along a length of said mounting rail, and said mounting rail also including a first opening into said groove along the length of said mounting rail, and said mounting rail further including a section of toothing disposed to be open along portions of surfaces on opposite sides of said first opening into said groove;

a clamping part including a clamping surface disposed in said groove to be in contact with a groove clamping surface extending inside said mounting rail, said clamping part also including an outside circumference portion disposed to extend from said groove and out of said mounting rail through said first opening; and a mounting apparatus including a second opening into which said clamping part outside circumference portion extends, a screw is disposed in said second opening and threaded into said clamping part so that said clamping part clamping surface is maintained in contact with said groove clamping surface, and said mounting apparatus further including at least one projection disposed to be in engagement contact with said mounting rail toothing.

2. The telescope fastening device according to claim 1, wherein said clamping part has a T-shaped exterior form including a sleeve-shaped portion that provides a vertical bar for the T-shaped exterior form, said vertical bar including a hole with internal threads for mating with threads on said screw, and said clamping part further including a crossbar portion for the T-shaped exterior form, said crossbar including said clamping surface.

3. The telescope fastening device according to claim 2, wherein a first portion of the T-shaped exterior form of said clamping part is disposed in a positive fit within said second opening in said mounting apparatus, and a second portion of the T-shaped exterior form of said clamping part also is disposed in a positive fit within said first opening to said groove.

4. The telescope fastening device according to claim 2, wherein said sleeve-shaped portion of the T-shaped exterior form of said clamping part is disposed to protrude into said first opening to said groove.

5. The telescope fastening device according to claim 2, wherein said sleeve-shaped portion of the T-shaped exterior form of said clamping part is disposed in a positive fit within said first opening to said groove, and said sleeve-shaped portion of the T-shaped exterior form of said clamping part also is disposed in a positive fit within said second opening in said mounting apparatus.

6. The telescope fastening device according to claim 2, wherein said sleeve-shaped portion of the T-shaped exterior form of said clamping part is disposed to protrude in a positive fit into said first opening to said groove.

7. The telescope fastening device according to claim 1, wherein said mounting rail protrudes into a rectangular shaped recess in said mounting apparatus.

8. The telescope fastening device according to claim 1, further comprising a cover disposed to close said first opening adjacent said mounting apparatus.

9. A telescope fasting device for mounting a telescope housing to a weapon, said telescope fastening device comprising:

a mounting rail disposed from said telescope housing, said mounting rail including a groove extending along a length of said mounting rail, and said mounting rail also including a first opening into said groove along the length of said mounting rail, and said mounting rail further including a section of toothing disposed to be open along portions of surfaces on opposite sides of said first opening into said groove;

a clamping part including a clamping surface disposed in said groove to be in contact with a groove clamping surface extending inside said mounting rail;

a mounting apparatus including a second opening in which a screw is disposed and threaded into said clamping part so that said clamping part clamping surface is maintained in contact with said groove clamping surface; and an insert disposed between said clamping part and said mounting apparatus, said insert including at least one projection disposed to be in engagement contact with said mounting rail toothing.

10. The telescope fastening device according to claim 9, wherein said insert includes an outside circumference disposed to be in a positive fit within said second opening in said mounting apparatus.

11. The telescope fastening device according to claim 9, wherein said insert has a T-shaped exterior form including a sleeve-shaped portion that provides a vertical bar for the T-shaped exterior form, said sleeve-shaped portion of the T-shaped exterior form is disposed into said second opening in said mounting apparatus, and said insert further includes a cross bar portion for the T-shaped exterior form, said crossbar also is disposed into said second opening in said mounting apparatus to be in contact with an inside shoulder disposed in said second opening in said mounting apparatus.

12. The telescope fastening device according to claim 9, wherein said insert includes a third opening and a portion of said clamping part is disposed in said third opening.

13. The telescope fastening device according to claim 1, wherein said mounting apparatus further includes a third opening in which a second screw is disposed and threaded into a second clamping part including a second clamping part clamping surface maintained in contact with said groove clamping surface.

14. The telescope fastening device according to claim 9, wherein said mounting apparatus further includes a third opening in which second screw is disposed and threaded into a second clamping part including a second clamping part clamping surface maintained in contact with said groove clamping surface.

15. A method for fastening a telescope housing to a weapon, the method comprising:

inserting a clamping part in a groove extending along a length of a mounting rail disposed from said telescope housing, said mounting rail including a first opening into said groove along the length of said mounting rail, and said mounting rail further including a section of toothing disposed to be open along portions of surfaces on opposite sides of said first opening into said groove;

positioning said clamping part so a clamping part clamping surface is in contact with a groove clamping surface extending inside said mounting rail, and also positioning said clamping part so an outside circumference portion extends from said groove and out of said mounting rail through said first opening;

tightening a screw inserted through a second opening in a mounting apparatus and threaded into said clamping part so that said clamping part outside circumference extends into said second opening and said clamping surface is maintained in contact with said groove clamping surface; and positioning a projection extending from said mounting apparatus to be in engagement contact with said mounting rail toothing.

16. The method according to claim 15 further comprising positioning a cover in said first opening adjacent said mounting apparatus.

17. A method for fastening a telescope housing to a weapon, the method comprising:

inserting a clamping part in a groove extending along a length of a mounting rail disposed from said telescope housing, said mounting rail including first opening into said groove along the length of said mounting rail, and said mounting rail further including a section of toothing disposed to be open along portions of surfaces on opposite sides of said first opening into said groove;

positioning said clamping part so a clamping part clamping surface is in contact with a groove clamping surface extending inside said mounting rail;

positioning an insert between said clamping part and a mounting apparatus so a projection extending from said insert is in engagement contact with said mounting rail toothing; and tightening a screw inserted through a second opening in said mounting apparatus and threaded into said clamping part so that said clamping part surface is maintained in contact with said groove clamping surface.

* * * * *